United States Patent [19]

Plazanet

[11] Patent Number: 5,058,229

[45] Date of Patent: Oct. 22, 1991

[54] MACHINE AND DRIVE DISK FOR THE REPAIR AND/OR MAINTENANCE OF FLOORS

[76] Inventor: Maurice P. Plazanet, 34, avenue Jean Racine, 92330 Sceaux, France

[21] Appl. No.: 491,083

[22] Filed: Mar. 9, 1990

[30] Foreign Application Priority Data

Mar. 17, 1989 [FR] France ..... 89 03546

[51] Int. Cl.[5] ..... A47L 11/283

[52] U.S. Cl. ..... 15/49.1; 15/98; 15/180; 51/177

[58] Field of Search ..... 15/49.1, 50.1, 98, 180, 15/385; 51/177; 299/41

[56] References Cited

U.S. PATENT DOCUMENTS

| | | | |
|---|---|---|---|
| 1,777,915 | 8/1927 | Douglas . | |
| 2,168,692 | 8/1939 | Vidal | 15/50.1 X |
| 3,464,075 | 9/1969 | Sullivan . | |
| 3,760,448 | 9/1973 | Scott et al. | 15/180 |
| 3,860,989 | 1/1975 | Johnston | 51/177 X |
| 4,319,434 | 3/1982 | Brejcha | 15/49.1 X |
| 4,590,635 | 5/1986 | Tucker et al. | 15/50.1 |
| 4,631,775 | 12/1986 | Palmer et al. | 15/98 X |
| 4,731,956 | 3/1988 | Wood | 15/49.1 X |
| 4,747,176 | 5/1988 | Parks | 51/177 X |

FOREIGN PATENT DOCUMENTS

| | | |
|---|---|---|
| 0073725 | 3/1983 | European Pat. Off. . |
| 0182178 | 5/1986 | European Pat. Off. . |
| 1008886 | 5/1957 | Fed. Rep. of Germany . |
| 2369819 | 6/1978 | France . |
| 1083775 | 9/1967 | United Kingdom . |
| 2033214 | 5/1980 | United Kingdom . |

*Primary Examiner*—William A. Cuchlinski, Jr.
*Assistant Examiner*—James K. Folker
*Attorney, Agent, or Firm*—Marshall, O'Toole, Gerstein, Murray & Bicknell

[57] ABSTRACT

A machine for the repair and/or maintenance of floors comprises a motor connected to rotate at least one rotary tool via a drive shaft substantially orthogonal to the tool. The tool is attached to the drive shaft by a disk connected at its external periphery to the tool, and at its center to the drive shaft, which permits relative inclination of the axis of rotation of the tool with respect to the drive shaft. The drive disk is made from a material which is supple perpendicularly to its plane but which is rigid, i.e., resistant to torque, in its plane. The drive disk is mounted between the tool and the drive shaft so as to form radially at least one undulation about the axis of the tool when the machine rests on the tool and when the axis of the tool is coaxial with that of the drive shaft.

12 Claims, 7 Drawing Sheets

Fig. 1
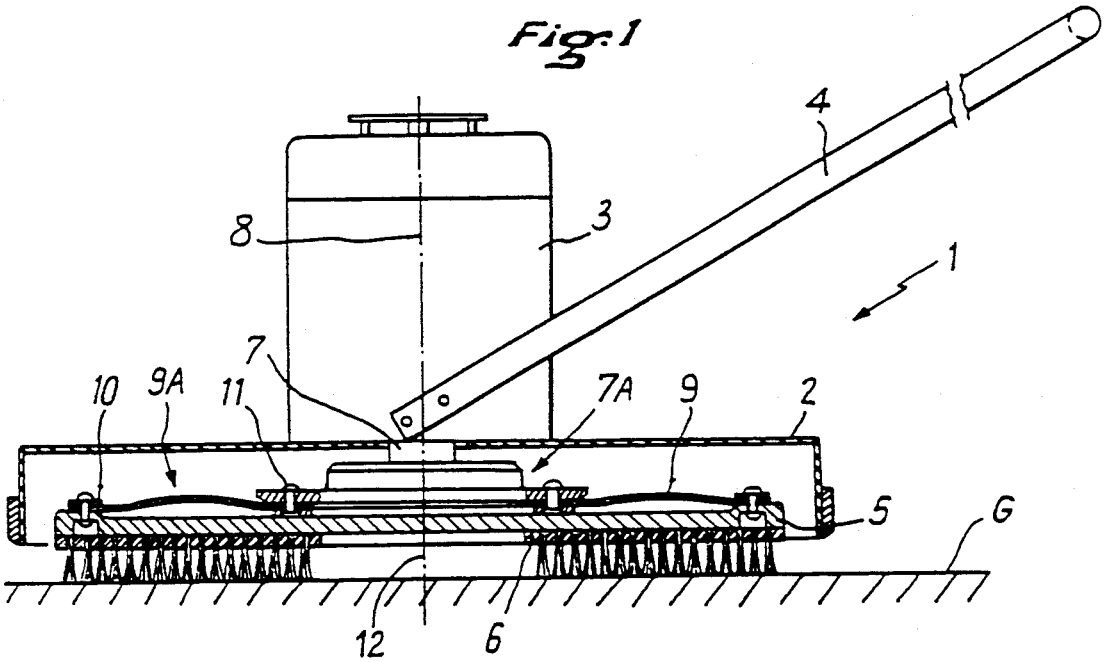
Fig. 2
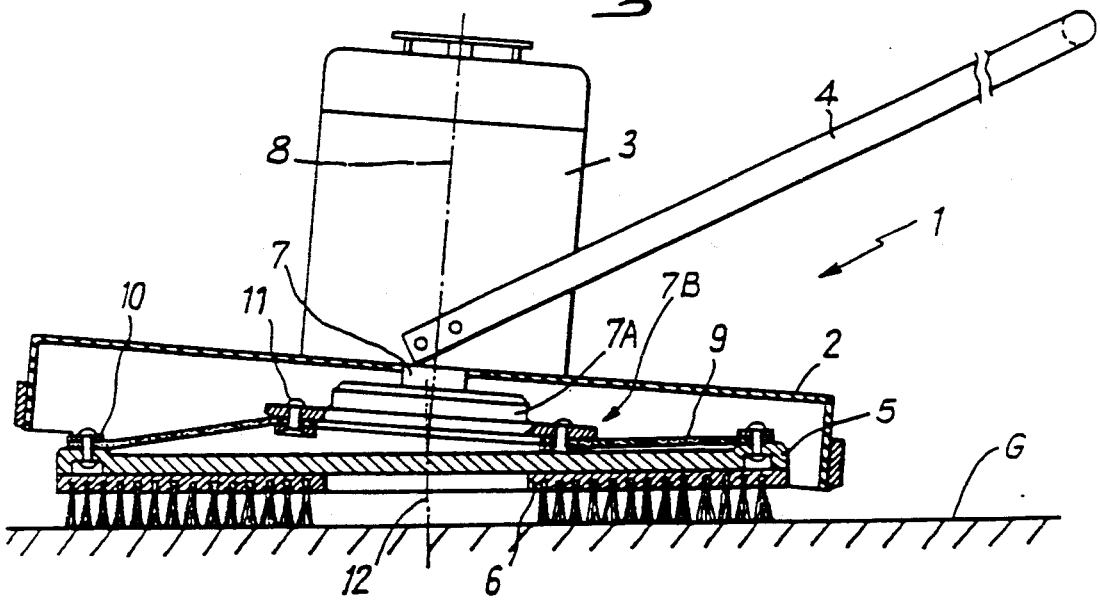
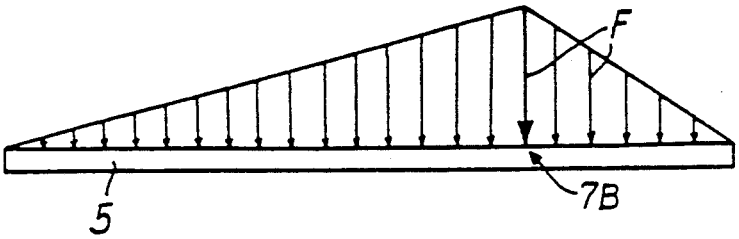
Fig. 3

MACHINE AND DRIVE DISK FOR THE REPAIR AND/OR MAINTENANCE OF FLOORS

BACKGROUND OF THE INVENTION

1. Field of the Invention

The present invention relates to a machine for the repair and/or maintenance of surfaces, and more particularly floors.

2. Description of the Prior Art

Such a machine is known, particularly from the patents GB-A-1 083 775 and U.S. Pat. No. 3 464075 comprising a motor rotatably driving at least one rotary tool via a drive shaft at least substantially orthogonal to said tool, said tool being connected to said drive shaft by a drive disk connected, in the vicinity of its external periphery, to the tool and, in the vicinity of its center, to the drive shaft and making possible a relative inclination of limited amplitude of the axis of rotation of the tool with respect to said drive shaft. However, in these known machines, said disk is made from a resilient material (metal or rubber) so that the degree of freedom of the tool parallel to the axis of the tool is limited by the resilience of the disk and the result is defects of coplanarity of the tool with respect to the floor. Consequently, the treated surface is worked irregularly by said tool, so that it cannot be perfectly uniform.

SUMMARY OF THE INVENTION

The object of the present invention is to perfect a machine of the above defined type.

For this, the machine for repair and/or maintenance of floors, of the above mentioned type, is remarkable, according to the invention, in that said drive disk is made from a material which is supple perpendicularly to its plane but which is rigid in its plane and in that said drive disk is mounted, between said tool and said drive shaft, so as to form radially at least one undulation about said axis of the tool when the machine rests on said tool and when the axis of said tool is coaxial with that of said drive shaft.

Since the material forming said drive disk is rigid in its plane, the disk may transmit the torque of the drive shaft to said tool, so that the latter is driven in rotation. Furthermore, since the material of the drive disk is supple perpendicularly to its plane, the undulation(s) form an excess of material parallel to the axis of the tool.

Thus, such a connecting means may, particularly on start-up, permit "decoupling" of the tool from the rest of the machine, facilitating starting of the tool and holding the latter perfectly parallel to the floor to be treated, during the treatment. In addition, as will be seen hereafter, the connecting means, such as defined above, allows distribution of forces on the tool, which permits lateral displacement of the machine.

Advantageously, said drive disk is formed of a synthetic material cloth which is rigid under rotational shear. Such a cloth may for example be of the type used for forming conveyor belts. It may be formed of crossed fabrics of polyester fibers coated with polyvinyl chloride.

In the case where said disk is fast, in the vicinity of its center, with a collar fixed to said drive shaft, it is advantageous, by relative inclination of the axis of said drive shaft with respect to the axis of rotation of said tool, for the external periphery of said collar to be able to press said tool locally against the floor. Thus, in line with this local pressure, the friction of the tool on the floor is higher than elsewhere so that, because of the rotation of the tool, the machine undergoes spontaneous displacement with respect to the treated floor. By choosing the position of this local pressure, the direction of spontaneous displacement can be determined.

To facilitate such an inclination capable of generating such spontaneous displacement, it is preferable for the drive shaft of the machine to be mounted on a universal joint and for a linkage acting on the universal joint to be provided for controlling the relative inclination between the drive shaft and the axis of rotation of the tool.

According to another characteristic of the invention, the machine comprises specific means for exerting a local pressure on said tool in the direction of the floor.

Preferably, said specific pressure means comprise a disk shaped piece having a flange at its external periphery, turned towards said drive disk and capable of being applied locally on the latter by a portion of its perimeter. Said specific pressure means may, in a variant, comprise a disk-shaped piece whose face turned towards the disk has a convex profile in cross section. This convex profile makes it possible to vary radially the point of application of said pressure means on the drive disk, so as to increase or decrease the speed of lateral displacement of the machine.

Furthermore, in its center, said pressure disk may have a hollow shaft through which the drive shaft passes.

In addition, said hollow shaft may be mounted, via a bearing, in a ring fast with a control linkage.

Advantageously, said linkage comprises a first link extending along a handle, articulated to a second link having the general shape of a fork.

Preferably, said second link has two legs whose respective free ends are articulated on each side of the pressure means.

BRIEF DESCRIPTION OF THE DRAWINGS

The figures of the accompanying drawings will better show how the invention may be implemented. In these figures, identical references designate similar elements.

FIG. 1 is a partial longitudinal sectional view of a first embodiment of a machine according to the invention;

FIG. 2 is a view similar to FIG. 1, in which the drive shaft of the motor of the machine is in an inclined position with respect to the axis of rotation of the tool;

FIG. 3 illustrates the distribution of forces applying the tool to the floor, when the machine is in the position shown in FIG. 2;

DESCRIPTION OF THE PREFERRED EMBODIMENTS

Figure 4:
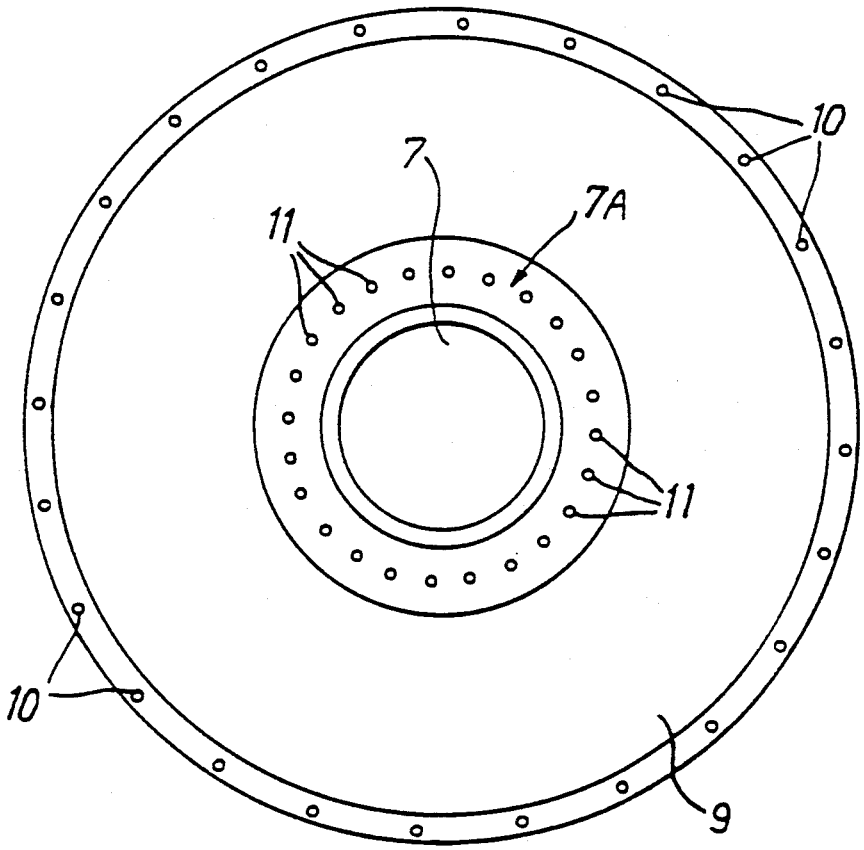
FIG. 4 is a top view of one embodiment of the drive disk.
Figure 5:
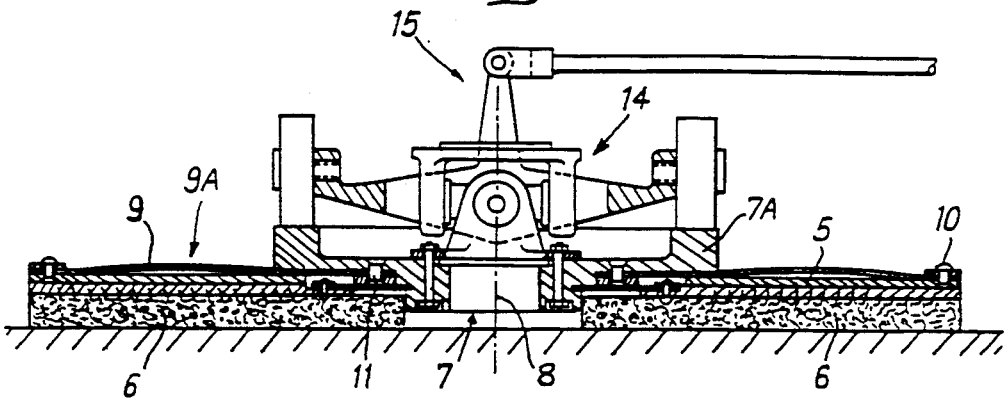
FIG. 5 is a partial view, in particular without chassis or motor, in longitudinal section, of a second embodiment of the machine according to the invention in which the drive shaft of the motor is mounted on a universal joint.

The machine of the invention, in the embodiment shown in FIGS. 1 and 2, in which the machine is without rolling means, comprises a chassis 2 on which is mounted a motor 3 connected to a handle 4 permitting the operator to handle the machine. In particular, handle 4 may be equipped with hand-grips and control means (not shown).

Motor 3 is capable of rotating a rotary tool 5 which may for example be equipped with a brush 6 or any other appropriate means such as a grinding wheel, a fibrous or abrasive material pad for the repair, cleaning and/or maintenance of a floor G, by means of a drive shaft 7 rotating about axis 8, at least substantially orthogonal to tool 5.

Furthermore, tool 5 is connected to drive shaft 7 by a drive disk 9 made from a material which is supple perpendicularly to its plane but which is rigid in its plane. Drive disk 9 is connected, in the vicinity of its external periphery, to tool 5 by appropriate fixing means 10, such as rivets, bolts or similar and, in the vicinity of its center, to a collar 7A fixed to drive shaft 7 also by appropriate fixing means 11, such as rivets, bolts or similar.

As shown in FIG. 1, the drive disk 9, which may be made from a synthetic material cloth which is rigid under rotational shear is mounted so as to form radially at least one undulation 9A about axis 12 of tool 5, when said machine rests on said tool and when the axis 12 thereof is coaxial with the axis 8 of the drive shaft 7. Thus, such an undulation provides a loose connection between collar 7A and tool 5, parallel to axis 8 and 12.

Thus, such an undulating disk 9, on start-up, allows "decoupling" of the tool from the rest of the machine by raising the latter, facilitating setting the tool in rotation and holding the tool perfectly parallel to the floor to be treated.

As shown in FIG. 2, the drive disk 9 thus mounted in addition allows a relative inclination between the axis of rotation 12 of tool 5 and drive shaft 7 which, associated with the above indicated structural characteristics of disk 9, when collar 7A presses the tool 5 against floor G locally at 7B, distributes the forces F on tool 5, as shown in FIG. 3, thus making in combination with the rotation of said tool a spontaneous lateral displacement of the machine possible (in FIG. 3, the length of arrows F is proportional to the intensity of the forces applied). Of course, the direction of this spontaneous lateral displacement depends on the position of point 7B about axis 12. The machine 1 may then be displaced without effort in any desired direction by choosing the point of application 7B of the local pressure.

Figure 6:
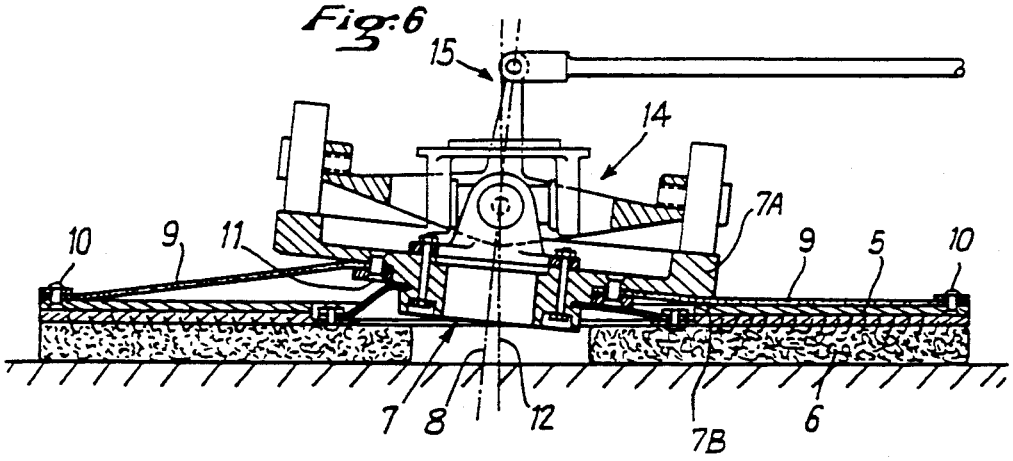
FIG. 6 is a view similar to FIG. 5, in which the drive shaft is in an inclined position with respect to the axis of rotation of the tool.
Figure 7:
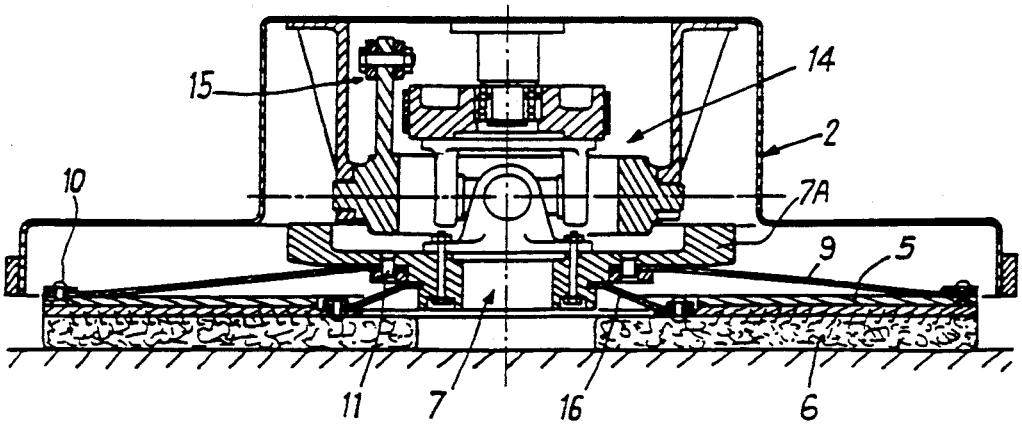
FIG. 7 illustrates the relative positions of the tool and of the rest of the machine on start-up.
Figure 8:
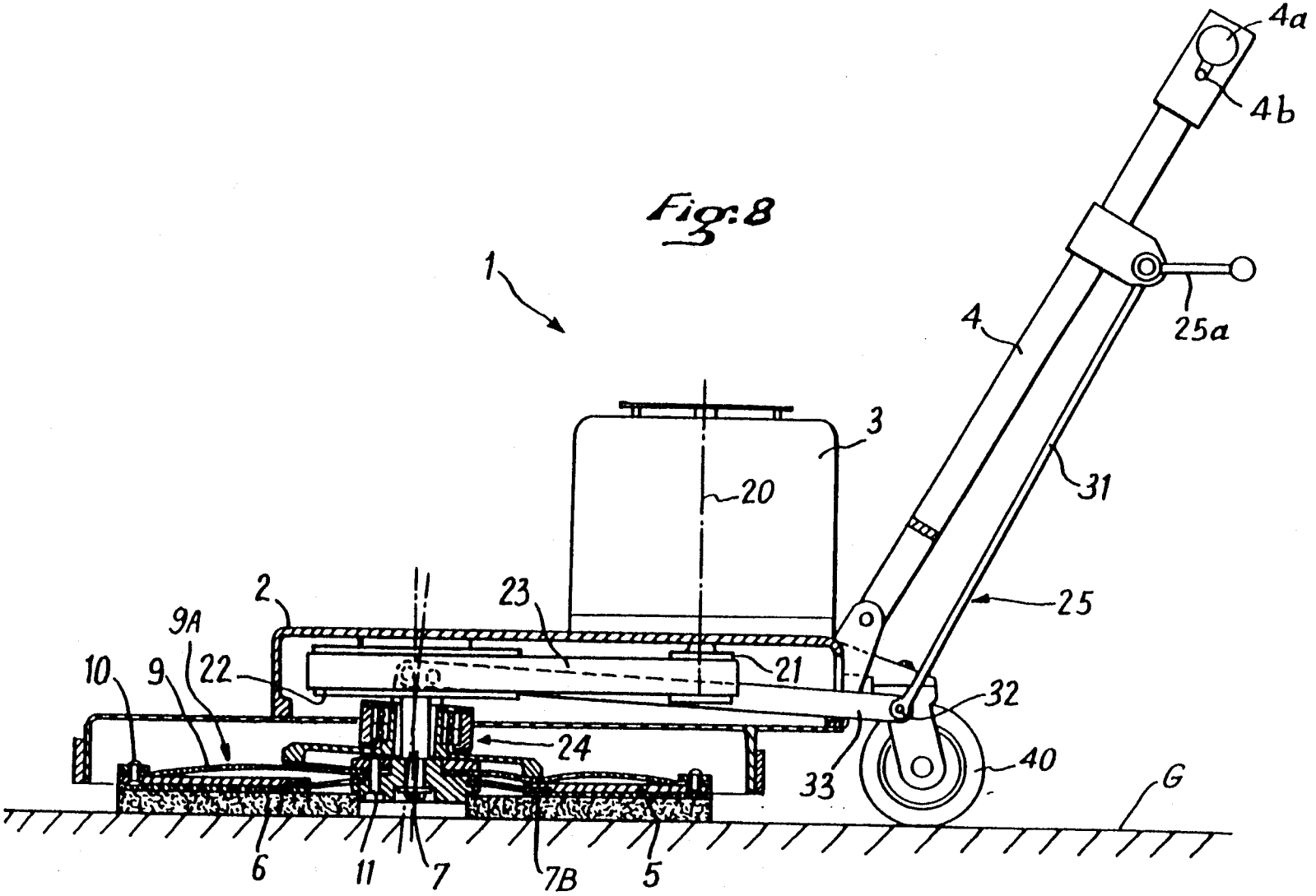
FIG. 8 is a partial longitudinal sectional view of a third embodiment of a machine according to the invention.
Figure 9:
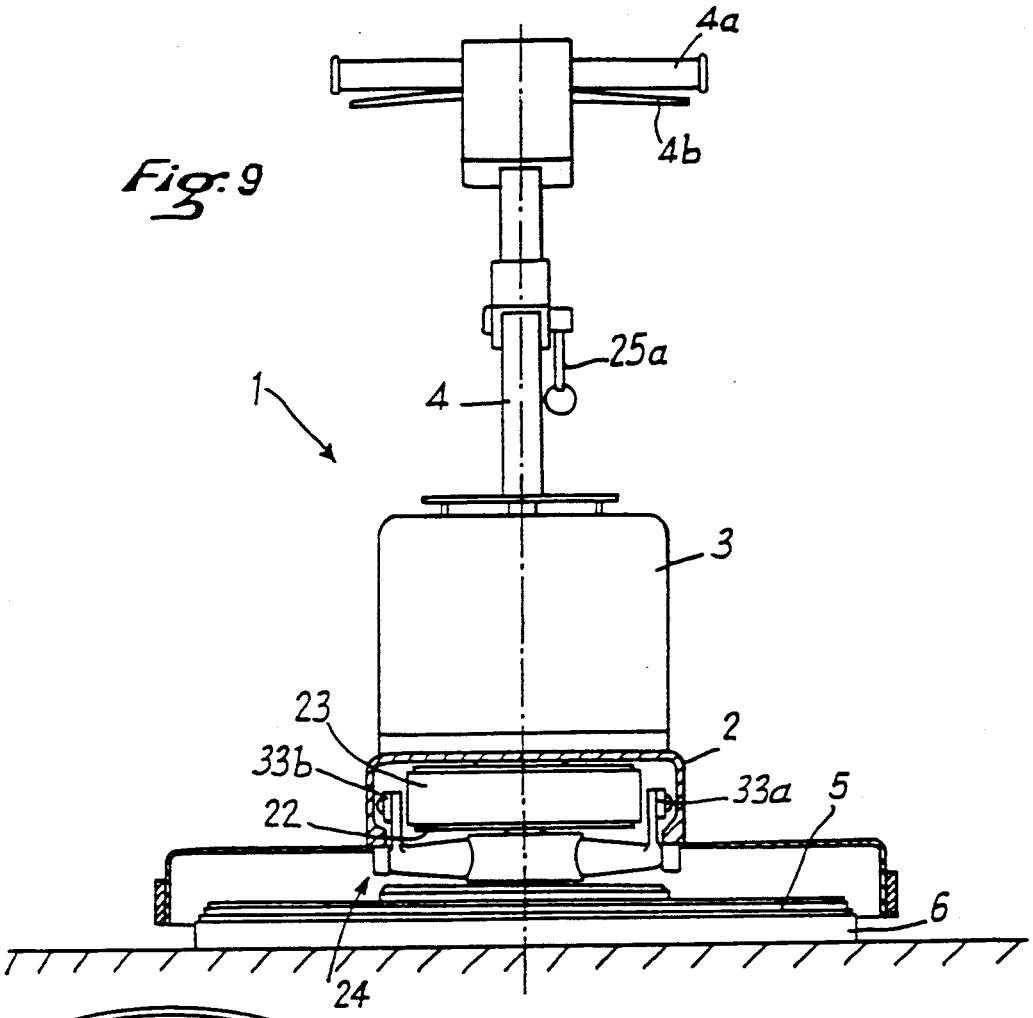
FIG. 9 is a partial sectional front view of the machine according to FIG. 8.
Figure 10:
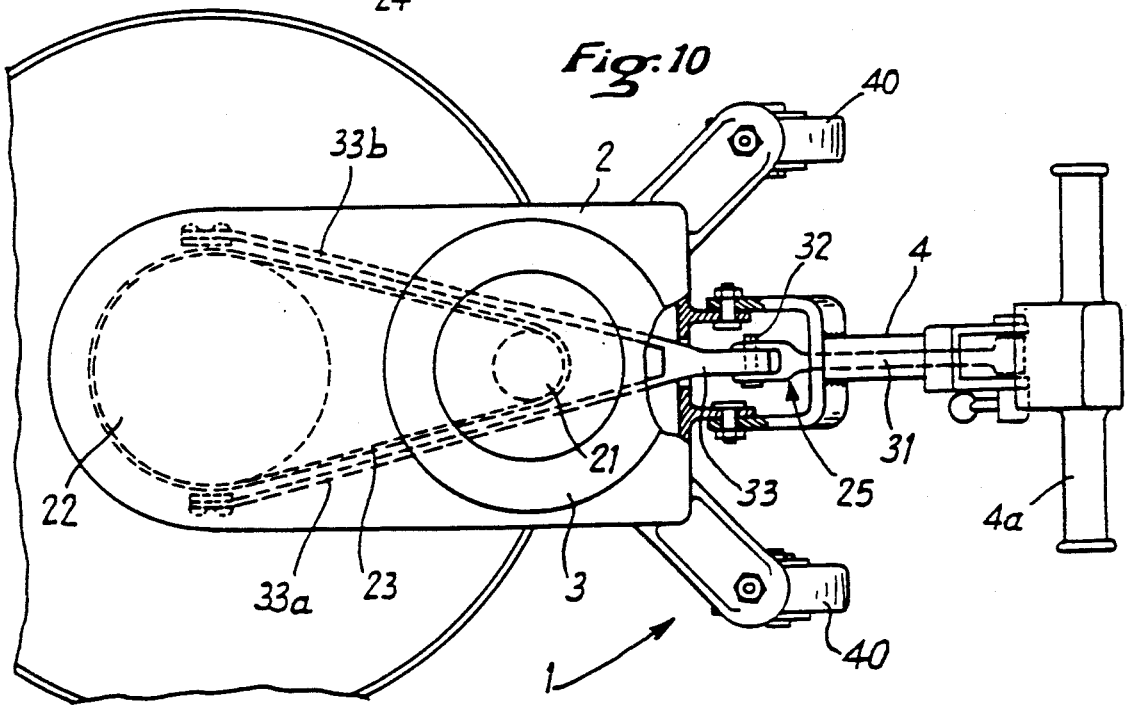
FIG. 10 is a top view, with parts cut away, of the machine of FIG. 8.

The embodiment of the machine according to the invention illustrated in FIGS. 6 to 7 comprises generally the same, or similar, elements as the machine of FIGS. 1 and 2, in particular the drive disk g connecting tool 5 to the drive shaft 7 and, in addition, rolling means not shown.

Moreover, in this case, the drive shaft 7 is mounted on a universal joint 14 which is connected to chassis 2 and the purpose of which is to provide even better parallelism of the tool with respect to the floor. The inclination of the universal joint 14 and thus of the drive shaft 7, with respect to the axis of rotation 12 of tool 5, is controlled by a linkage 15. A flexible ring 16 guarantees sealing between the drive shaft 7 and tool 5. In the embodiment shown in FIGS. 8 to 11, machine 1 again comprises a chassis 2, on which is mounted a motor 3 connected to a handle 4 equipped with hand-grips 4A and control means 4B. Machine 1 is provided with rolling means bearing the reference 40, comprising two wheels arranged at the rear of the machine.

As before, motor 3 is capable of rotating a rotary tool 5, having a brush 6 or similar, via a drive shaft 7 rotating about axis 8 orthogonal to tool 5.

More precisely, the shaft of motor 3 with axis of rotation 20 has, at its free end, a pulley 21 connected to a pulley 22 which is carried by the drive shaft 7, by means of a belt 23.

Also in this case, tool 5 is connected to drive shaft 7 by a drive disk 9 having the characteristics already described. In particular, disk 9 may be in the form of a cloth (as shown).

The drive disk 9 is connected, in the vicinity of its external periphery, to tool 5 and, in the vicinity of of its center, to the drive shaft 7 by appropriate fixing means 10 and 11, respectively.

Moreover, in this case, specific means 24 are provided for exerting a local pressure on the drive disk 9 for reinforcing the lateral displacement effect, which means 24 are actuated by a linkage 25 whose free end 25A is fixed to handle 4 in the vicinity of the hand-grips 4A, for control thereof by the operator. As can be best seen in FIG. 11, these means 24 comprise a disk-shaped piece 26 having a flange 27 at its external periphery, turned towards the drive disk 9 and intended to be applied against the latter by a portion of its perimeter, at any point of the drive disk 9 about the drive shaft 7, application taking place in the vicinity of of said drive shaft 7.

In its center, disk 26 has a hollow shaft 28 through which passes shaft 7 connected to pulley 22. The hollow shaft 28 is mounted, via a bearing 29, in a ring 30 fast with the linkage 25.

The linkage 25 comprises a first link 31 extending along the handle 4 and articulated at 32 to a second link having the general shape of a fork 33 with two legs 33A, 33B whose respective free ends are articulated on each side of the pressure means 24 controlling the inclination thereof.

Figure 11:
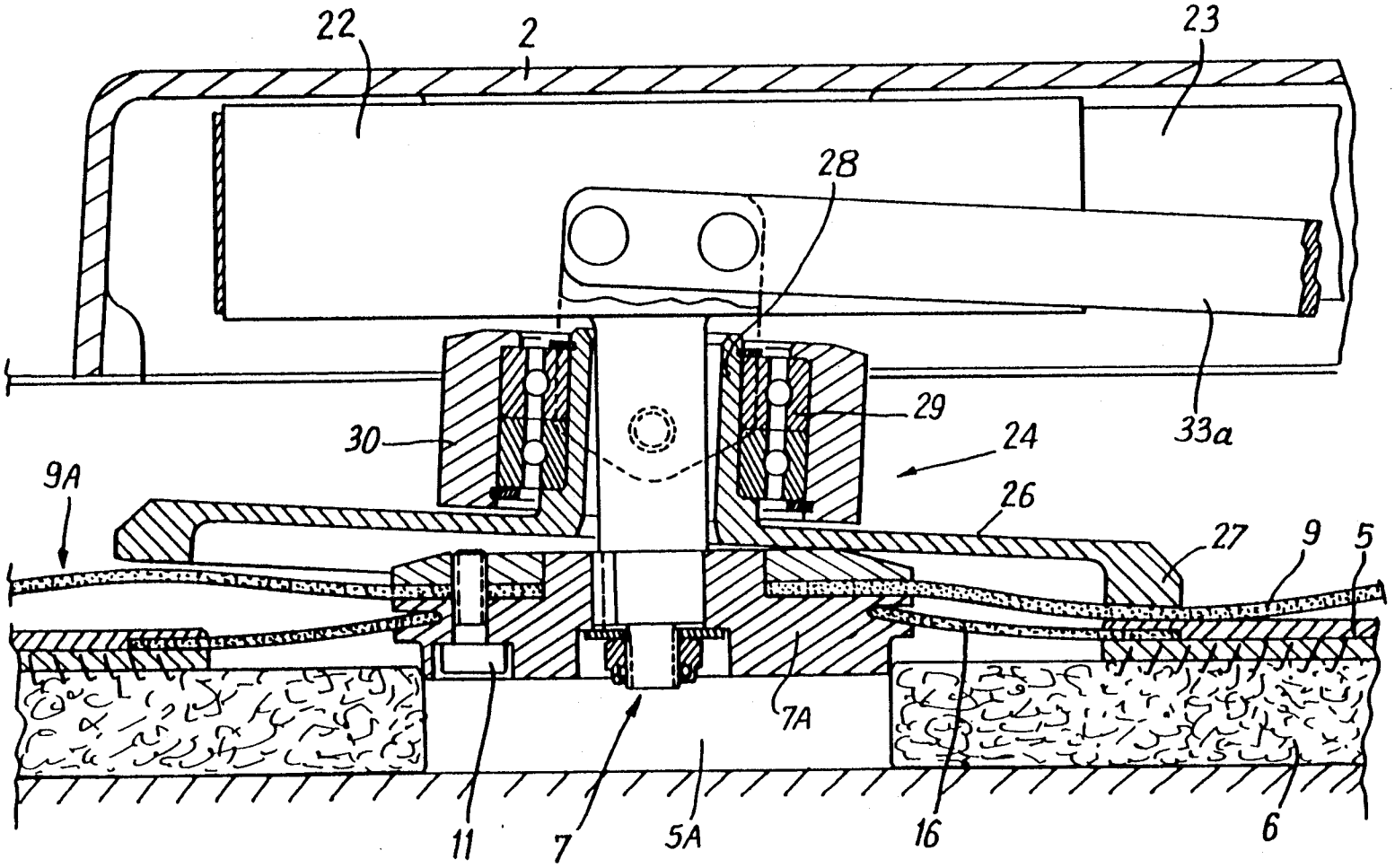
FIG. 11 shows an enlarged detail of FIG. 8.
Figure 12:
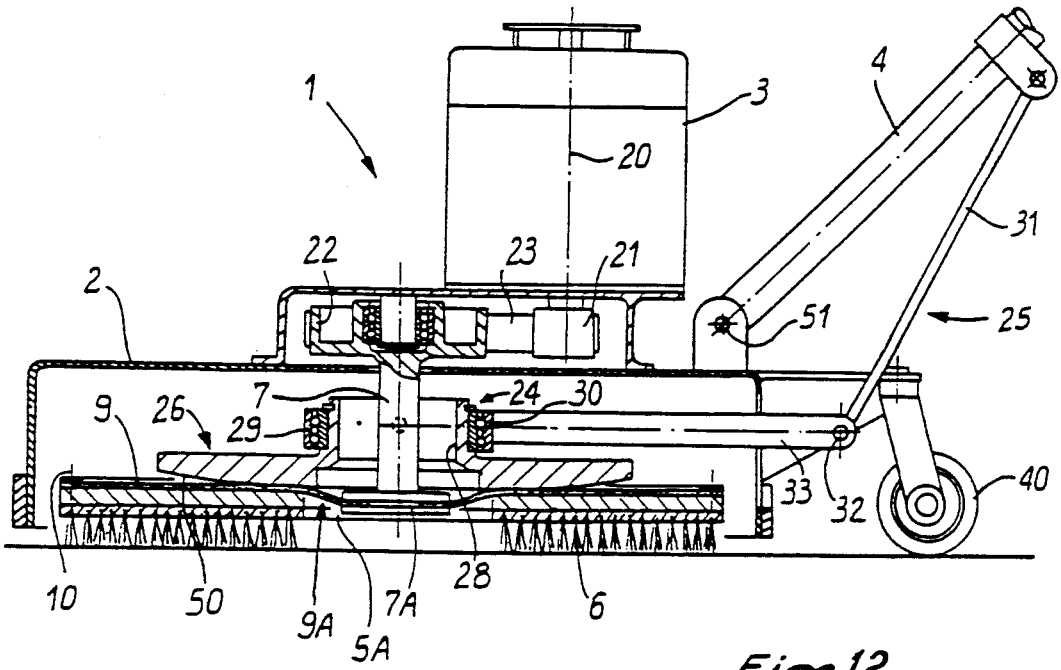
FIG. 12 is a partial longitudinal sectional view of a variant of the third embodiment of the machine according to the invention, illustrated by FIGS. 8 to 11.
Figure 13:
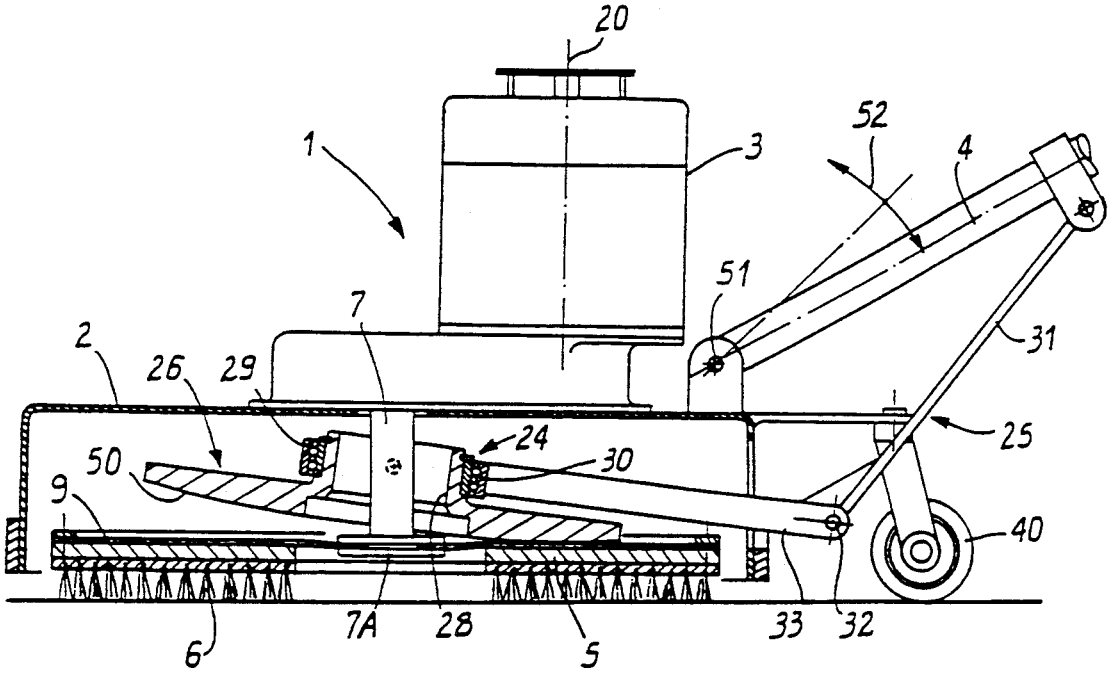
FIG. 13 is a view similar to FIG. 12, showing the application of the specific pressure means on the connecting member.

The modification of the machine shown in FIGS. 12 and 13 generally comprises the same component elements as the machine shown in FIGS. 8 to 11. However, the specific means 24 for exerting a local pressure on drive disk 9 has a somewhat different structure. In fact, in this case, these means 24 also comprise a disk-shaped piece 26 whose face 50 turned towards the drive disk 9 has, in cross section, a convex profile so as to vary radially the point of application of said pressure means 24 on the drive disk 9, thus making it possible to increase or decrease the lateral speed of the machine. This variation of the point of application is obtained by pivoting handle 4 about the articulation 51, as illustrated by the double arrow 52.

In the embodiment of FIGS. 8 to 11, the pressure disk 26 has, in its center, a hollow shaft 28 through which passes shaft 7 connected to pulley 22. The hollow shaft 28 is mounted, via a bearing 29, in a ring 30 fast with the linkage 25.

By comparing FIGS. 1, 2 and 5 to 8, on the one hand, and FIGS. 11 to 13 on the other, it may be noted that, depending on whether tool 5 comprises a central recess 5A or not and whether collar 7A penetrates inside said central recess 5A or not, the undulation(s) 9A formed by the excess of material of drive disk 9 are formed at radially different positions.

What is claimed is:

1. A machine for the repair and/or maintenance of floors, of the type comprising a motor which rotates at least one rotary tool via a drive shaft at least substantially orthogonal to said tool, said tool being connected to said drive shaft by a disk connected, in the vicinity of its external periphery, to the tool and, in the vicinity of its center, to the drive shaft and permitting relative inclination of limited amplitude of the axis of rotation of the tool with respect to said drive shaft, wherein said drive disk is made from a material which is supple perpendicularly to its plane but which is rigid in its plane and said drive disk is mounted, between said tool and said drive shaft, so as to form radially at least one undulation about said axis of the tool when the machine rests on said tool and when the axis of said tool is coaxial with that of said drive shaft.

2. The machine as claimed in claim 1, wherein said drive disk is formed of a synthetic material cloth.

3. The machine as claimed in claim 1, in which said drive disk is fast, in the vicinity of its center, with a collar fixed to said drive shaft, wherein by relative inclination of the axis of said drive shaft with respect to the axis of rotation of said tool, the external periphery of said collar may press said tool locally against the floor.

4. The machine as claimed in claim 1, with said drive shaft mounted on a universal joint, a linkage acting on the universal joint for controlling the relative inclination between the drive shaft and the axis of rotation of the tool.

5. The machine as claimed in claim 1, further comprising specific means for exerting a local pressure on said tool in the direction of the floor, at a point of said tool close to its axis of rotation.

6. The machine as claimed in claim 5, wherein said specific pressure means comprise a disk shaped piece having a flange at its external periphery, turned towards said drive disk and capable of being applied locally on the latter by a portion of its perimeter.

7. The machine as claimed in claim 5, wherein said specific pressure means comprise a disk-shaped piece whose face turned towards the disk has a convex profile in cross section.

8. The machine as claimed in claim 6, wherein, in its center, said pressure disk has a hollow shaft through which the drive shaft passes.

9. The machine as claimed in claim 8, wherein said said hollow shaft is mounted, via a bearing, in a ring fast with a control linkage.

10. The machine as claimed in claim 9, wherein said linkage comprises a first link extending along a handle and articulated to a second link having the general shape of a fork.

11. The machine as claimed in claim 10, wherein said second link has two legs whose respective free ends are articulated on each side of the pressure means.

12. A drive disk intended for a machine for the repair and/or maintenance of floors, of the type comprising a motor which rotates at least one rotary tool via a drive shaft at least substantially orthogonal to said tool, said tool being connected to said drive shaft by said drive disk which is connected, in the vicinity of its external periphery, to the tool and, in the in the vicinity of its center, to the drive shaft and permitting inclination of limited amplitude of the axis of rotation of the tool with respect to said drive shaft, wherein said drive disk is made from a material which is supple perpendicularly to its plane but which is rigid in its plane, so as to form radially at least one undulation about said axis of the tool when the machine rests on said tool and when the axis of said tool is coaxial with that of said drive shaft.

* * * * *